US009644252B2

(12) United States Patent
Maki et al.

(10) Patent No.: US 9,644,252 B2
(45) Date of Patent: May 9, 2017

(54) HOT STAMPED HIGH STRENGTH PART EXCELLENT IN POST PAINTING ANTICORROSION PROPERTY AND METHOD OF PRODUCTION OF SAME

(71) Applicant: NIPPON STEEL & SUMITOMO METAL CORPORATION, Tokyo (JP)

(72) Inventors: Jun Maki, Tokyo (JP); Kazuhisa Kusumi, Tokyo (JP); Masayuki Abe, Tokyo (JP); Masao Kurosaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 174 days.

(21) Appl. No.: 14/608,849

(22) Filed: Jan. 29, 2015

(65) Prior Publication Data

US 2015/0191813 A1 Jul. 9, 2015

Related U.S. Application Data

(62) Division of application No. 14/008,854, filed as application No. PCT/JP2012/058655 on Mar. 30, 2012, now Pat. No. 8,986,849.

(30) Foreign Application Priority Data

Apr. 1, 2011 (JP) ..... 2011-081995

(51) Int. Cl.
*B21B 1/26* (2006.01)
*C23C 2/12* (2006.01)
(Continued)

(52) U.S. Cl.
CPC ..... *C23C 2/12* (2013.01); *B21B 1/26* (2013.01); *C21D 1/673* (2013.01); *C21D 7/13* (2013.01);
(Continued)

(58) Field of Classification Search
CPC ..... C23C 2/12; C23C 2/40; B21B 2001/221; B21B 2001/228; B21B 1/26; B21D 22/022; B21D 37/16; C21D 8/0226; C21D 7/13
See application file for complete search history.

(56) References Cited

U.S. PATENT DOCUMENTS 5,582,658 A * 12/1996 Masui ..... C21D 8/041 148/331
6,296,805 B1 10/2001 Laurent et al.
(Continued)

FOREIGN PATENT DOCUMENTS

CA 2729942 1/2010
JP 2003-034846 2/2003
(Continued)

OTHER PUBLICATIONS

Translation of WO2010/005121 A1; Jan. 2010.*
(Continued)

*Primary Examiner* — Edward Tolan
(74) *Attorney, Agent, or Firm* — Birch, Stewart, Kolasch & Birch, LLP

(57) ABSTRACT

A hot stamped high strength part in which the propagation of cracks which form at the plating layer at the time of hot stamping when hot stamping aluminum plated steel sheet is suppressed and the post painting anticorrosion property is excellent even without adding special ingredient elements which suppress formation of cracks in an aluminum plating layer is provided. A hot stamped high strength part which is excellent in post painting anticorrosion property, which hot stamped high strength part has an alloy plating layer which includes an Al—Fe intermetallic compound phase on the surface of the steel sheet, wherein the alloy plating layer is comprised from phases of a plurality of intermetallic compounds, a mean linear intercept length of crystal grains of a
(Continued)

phase containing A1: 40 to 65 mass % among the phases of the plurality of intermetallic compounds is 3 to 20 μm, an average value of thickness of the Al—Fe alloy plating layer is 10 to 50 μm, and a ratio of the average value of thickness to the standard deviation of thickness of the Al—Fe alloy plating layer satisfies the following relationship: ○<standard deviation of thickness/average value of thickness ≤0.15.

5 Claims, 6 Drawing Sheets

(51) Int. Cl.

| | |
|---|---|
| ***C21D 1/673*** | (2006.01) |
| ***C21D 7/13*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/26*** | (2006.01) |
| ***C23C 2/28*** | (2006.01) |
| ***C21D 8/02*** | (2006.01) |
| ***C22C 38/14*** | (2006.01) |
| ***C22C 38/20*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| ***C22C 38/44*** | (2006.01) |
| ***C22C 38/50*** | (2006.01) |
| ***C22C 38/54*** | (2006.01) |
| ***C22C 38/60*** | (2006.01) |
| ***C23C 2/34*** | (2006.01) |

(52) U.S. Cl.

CPC ..... *C21D 8/0226* (2013.01); *C21D 8/0236* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/06* (2013.01); *C22C 38/14* (2013.01); *C22C 38/20* (2013.01); *C22C 38/22* (2013.01); *C22C 38/28* (2013.01); *C22C 38/32* (2013.01); *C22C 38/38* (2013.01); *C22C 38/44* (2013.01); *C22C 38/50* (2013.01); *C22C 38/54* (2013.01); *C22C 38/60* (2013.01); *C23C 2/02* (2013.01); *C23C 2/26* (2013.01); *C23C 2/28* (2013.01); *C23C 2/34* (2013.01); *C21D 2211/004* (2013.01); *Y10T 428/12611* (2015.01); *Y10T 428/12757* (2015.01); *Y10T 428/12951* (2015.01); *Y10T 428/12972* (2015.01); *Y10T 428/31678* (2015.04)

(56) References Cited

U.S. PATENT DOCUMENTS

| | | | | |
|---|---|---|---|---|
| 6,673,472 | B2 * | 1/2004 | Maki | B05D 7/14 220/4.14 |
| 6,808,678 | B2 | 10/2004 | Murakami et al. | |
| 7,501,029 | B2 * | 3/2009 | Suzaki | C21D 8/1261 148/111 |
| 7,867,344 | B2 | 1/2011 | Kusumi et al. | |
| 9,340,860 | B2 * | 5/2016 | Furuhashi | C22C 38/04 |
| 2009/0123290 | A1 * | 5/2009 | Imano | B23K 9/044 416/241 R |
| 2011/0030441 | A1 | 2/2011 | Maki et al. | |
| 2011/0174418 | A1 * | 7/2011 | Maki | C21D 8/0205 148/531 |
| 2011/0300407 | A1 | 12/2011 | Cho et al. | |

FOREIGN PATENT DOCUMENTS

| | | | | |
|---|---|---|---|---|
| JP | 2003-034855 | | 2/2003 | |
| JP | 2003-049256 | | 2/2003 | |
| JP | 2003-181549 | | 7/2003 | |
| JP | 2007-211276 | | 8/2007 | |
| JP | 2007314874 | | 12/2007 | |
| JP | 2010-018860 | | 1/2010 | |
| WO | WO 02/103073 | | 12/2002 | |
| WO | 2009/131233 | | 10/2009 | |
| WO | 2010/005121 | A1 * | 1/2010 | C22C 38/38 |

OTHER PUBLICATIONS

International Search Report dated Jul. 3, 2012 issued in corresponding PCT Application No. PCT/JP2012/058655.

Extended European Search Report dated Oct. 6, 2014 issued in corresponding Application No. 12767860.5.

Suehiro M. et al; "Properties of aluminum-coated steels for hot forming"; Nippon Steel Technical Report Overseas, No. 88, Jul. 1, 2003, pp. 16-21; Tokyo, JP.

H. Karbasian et al; "A review on hot stamping"; Journal of Materials Processing Technology, vol. 210, No. 15, Nov. 1, 2010.

R. Kolleck et al; "Investigation on induction heating for hot stamping of boron alloyed steels"; CIRP Annals—Manufacturing Technology, vol. 58, No. 1, Jan. 1, 2009, pp. 275-278.

* cited by examiner (a)

(b)

(c)

(d)

(a)

(b)

HOT STAMPED HIGH STRENGTH PART EXCELLENT IN POST PAINTING ANTICORROSION PROPERTY AND METHOD OF PRODUCTION OF SAME

CROSS-REFERENCE TO RELATED APPLICATION

This application is a divisional application of U.S. application Ser. No. 14/008,854, filed Sep. 30, 2013, which is a national stage application of International Application No. PCT/JP2012/058655, filed Mar. 30, 2012, which claims priority to Japanese Application No. 2011-081995, filed Apr. 1, 2011, each of which is incorporated by reference in its entirety.

TECHNICAL FIELD

This application is a divisional application of U.S. application Ser. No. 14/008,854, filed Sep. 30, 2013, which is a national stage application of International Application No. PCT/JP2012/058655, filed Mar. 30, 2012, which claims priority to Japanese Application No. 2011-081995, filed Apr. 1, 2011, each of which is incorporated by reference in its entirety.

The present invention relates to an aluminum plated high strength part which is excellent in post painting anticorrosion property which is produced by press forming at a high temperature, that is, by hot stamping, and is suitable for members in which strength is required such as auto parts and other structural members, more specifically relates to a high strength part which is formed by hot stamping which is suppressed in propagation of cracks which form in the aluminum plating layer when hot stamping aluminum plated high strength steel sheet and which is excellent in post painting anticorrosion property, and a method of production of the same.

BACKGROUND ART

In recent years, in applications of steel sheet for automobile use (for example, automobile pillars, door impact beams, bumper beams, etc.) and the like, steel sheet in which both high strength and high formability are achieved has been desired. As one means for dealing with this, there is TRIP (transformation induced plasticity) steel which utilizes the martensite transformation of residual austenite. Using this TRIP steel, it is possible to produce high strength steel sheet which is excellent in formability and which has a 1000 MPa class or so strength, but securing formability with very high strength steel sheet of further higher strength, for example, 1500 MPa or more, has been difficult.

In view of this situation, the forming method which has been focused on most recently as a method for securing high strength and high formability has been hot stamping (also called hot pressing, hot stamping, die quenching, press quenching, etc.) This hot stamping heats the steel sheet to the 800° C. or higher austenite region, then forms it by a die when hot to thereby improve the formability of the high strength steel sheet and, after forming it, cools it in the press die to quench it and thereby obtain a shaped part of the desired quality.

Hot stamping is promising as a method for forming very high strength members, but usually includes a step of heating the steel sheet in the atmosphere. At this time, oxides (scale) form on the steel sheet surface, so a later step of removing the scale becomes necessary. In this regard, in such a later step, there was the problem of the need for measures from the viewpoint of the descaling ability and environmental load etc.

As art to alleviate this problem, the art of using aluminum plated steel sheet as the steel sheet for hot stamped member use so as to suppress the formation of scale at the time of heating has been proposed (for example, see PLTs 1 and 2).

Aluminum plated steel sheet is effective for the efficient production of a high strength shaped part by hot stamping. Aluminum plated steel sheet is usually pressed formed, then painted. The aluminum plating layer after heating at the time of hot stamping changes to an intermetallic compound up to the surface. This compound is extremely brittle. If subjected to a severe forming operation by hot stamping, the aluminum plating layer easily cracks. Further, the phases of this intermetallic compound have more electropositive potential than the matrix steel sheet, so there was the problem that the corrosion of the steel sheet material is started from the cracks as starting points and the post painting anticorrosion property falls.

To avoid the drop in the post painting anticorrosion property due to the formation of cracks in the aluminum plating layer, adding Mn to this intermetallic compound is extremely effective, so an aluminum plated steel sheet which is improved in post painting anticorrosion property by addition of 0.1% or more of Mn in the aluminum plating layer has been proposed (for example, see PLT 3).

The art which is described in PLT 3 adds specific ingredient elements in the aluminum plating layer to prevent cracks from forming in the aluminum plating layer, but is not art which prevents cracks from forming in the aluminum plating layer without addition of specific ingredient elements into the aluminum plating layer.

Further, aluminum plated steel sheet has been proposed where, if adding elements to the matrix steel of the aluminum plated steel sheet to give $Ti+0.1Mn+0.1Si+0.1Cr>0.25$, these elements promote diffusion between Al—Fe so that even if cracks are formed in the aluminum plating layer, an Fe—Al reaction proceeds from around them and therefore the steel sheet material is prevented from being exposed and the corrosion resistance is improved (for example, see PLT 4).

However, the art which is described in PLT 4 does not try to prevent cracks from forming at the aluminum plating layer.

CITATIONS LIST

Patent Literature

PLT 1: Japanese Patent Publication No. 2003-181549A
PLT 2: Japanese Patent Publication No. 2003-49256A
PLT 3: Japanese Patent Publication No. 2003-34855A
PLT 4: Japanese Patent Publication No. 2003-34846A

SUMMARY OF INVENTION

Technical Problem

The present invention was made in consideration of this situation and has as its object the provision of a hot stamped high strength part in which the propagation of cracks which form at the aluminum plating layer when hot stamping aluminum plated steel sheet is suppressed and the post painting anticorrosion property is excellent even without adding special ingredient elements which suppress formation of cracks in an aluminum plating layer. Further, it has as its object the formation of a lubricating film at the aluminum plating layer surface to improve the formability at the time of hot stamping aluminum plated steel sheet and suppress the formation of cracks in the aluminum plating layer. Furthermore, it has as its object the provision of a method of production of a hot stamped high strength part.

Solution to Problem

The inventors engaged in intensive research to solve the above problems and completed the present invention. In general, an aluminum plated steel sheet for hot stamped member use is formed with an aluminum plating layer at one or both surfaces of the steel sheet by hot dipping etc. The aluminum plating layer may contain, by mass %, Si: 2 to 7% in accordance with need and is comprised of a balance of Al and unavoidable impurities.

When an aluminum plating layer of aluminum plated steel sheet before hot stamping contains Si, it is comprised of an Al—Si layer and Fe—Al—Si layer from the surface layer. To hot stamp an aluminum plated steel sheet, first, the aluminum plated steel sheet is heated to a high temperature to make the steel sheet an austenite phase. Further, the aluminum plated steel sheet which is converted to austenite is press formed hot, then the shaped aluminum plated steel sheet is cooled. The aluminum plated steel sheet can be made a high temperature to make it soften once and facilitate the subsequent press forming. Further, the steel sheet may be heated and cooled so that it is quenched and an approximately 1500 MPa or higher mechanical strength is realized.

In the heating step of this aluminum plated steel sheet for hot stamped member use, inside the aluminum plating layer (when including Si), the Al—Si and the Fe from the steel sheet mutually diffuse thereby changing as a whole to an Al—Fe compound (intermetallic compound). At this time, in the Al—Fe compound, a phase which contains Si also is partially formed. This compound (intermetallic compound) is extremely brittle. If shaping it under severe conditions in hot stamping, cracks will form in the aluminum plating layer. Further, these phases have a potential more electropositive than the matrix steel sheet, so corrosion of the steel sheet material will begin from the cracks as starting points and the shaped part will be reduced in post painting anticorrosion property. Therefore, suppression of the cracks which form in the aluminum plating layer after hot stamping improves the post painting anticorrosion property of the part which is formed by hot stamping.

In hot stamping, it is not possible to avoid the formation of cracks in the aluminum plating layer, but the inventors took note of the fact that if it were possible to arrest the propagation of cracks of the aluminum plating layer which formed in hot stamping inside of the aluminum plating layer, the cracks would not reach the matrix steel sheet. They discovered that this would enable prevention of corrosion of the steel sheet material and prevention of a detrimental effect on the post painting anticorrosion property of the hot stamped part. The inventors engaged in intensive research on arresting the propagation of cracks of an aluminum plating layer for cracks which formed in the aluminum plating layer. As a result, they discovered that if controlling the mean linear intercept length of crystal grains of an intermetallic compound phase which contains Al in 40 to 65% among the crystal grains of the plurality of intermetallic compound phases based on Al—Fe which are formed at the surface of the steel sheet (below, sometimes simply referred to as the "mean linear intercept length") to 3 to 20 μm, it is possible to arrest the propagation of cracks which form in the aluminum plating layer. Further, they discovered that by further forming a lubrication film which contains ZnO at the aluminum plating layer surface, it is possible to secure a lubricating property at the time of hot stamping and possible to prevent surface defects and formation of cracks. Furthermore, they discovered a steel sheet composition which is suitable for hot stamping.

Furthermore, the inventors discovered that the thickness of the Al—Fe alloy plating layer has an effect on the state of spattering at the time of spot welding and discovered that to obtain stable spot weldability, it is important to reduce the deviation of the plating thickness (standard deviation), make the average value of thickness of the Al—Fe alloy plating layer 10 to 50 μm, and make the ratio of the average value of thickness to the standard deviation of thickness (standard deviation of thickness/average value of thickness) 0.15 or less.

The present invention was completed based on these discoveries and has as its gist the following:

(1) A hot stamped high strength part which is excellent in post painting anticorrosion property, comprising an alloy plating layer comprising an Al—Fe intermetallic compound phase on the surface of the steel sheet, the alloy plating layer is comprised from phases of a plurality of intermetallic compounds, a mean linear intercept length of crystal grains of a phase containing Al: 40 to 65 mass % among the phases of the plurality of intermetallic compounds is 3 to 20 μm, an average value of thickness of the Al—Fe alloy plating layer is 10 to 50 μm, and a ratio of the average value of thickness to the standard deviation of thickness of the Al—Fe alloy plating layer satisfies the following relationship:

$$0 < \text{standard deviation of thickness/average value of thickness} \leq 0.15.$$

(2) The hot stamped high strength part which is excellent in post painting anticorrosion property as set forth in the above (1) characterized in that the ratio of the average value of thickness to the standard deviation of thickness is 0.1 or less.

(3) The hot stamped high strength part which is excellent in post painting anticorrosion property as set forth in the above (1) or (2) characterized in that the Al—Fe alloy plating layer contains, by mass %, Si: 2 to 7%

(4) The hot stamped high strength part which is excellent in post painting anticorrosion property as set forth in the above (1) or (2) characterized in that a surface film layer which contains ZnO is provided on the surface of the Al—Fe alloy plating layer.

(5) The hot stamped high strength part which is excellent in post painting anticorrosion property as set forth in the above (4) characterized in that a content of ZnO of the surface film layer is, converted to mass of Zn, 0.3 to 7 $g/m^2$ per side.

(6) The hot stamped high strength part which is excellent in post painting anticorrosion property as set forth in the above (1) or (2) characterized in that the steel sheet is comprised of steel sheet of chemical ingredients which comprise as ingredients, by mass %, C: 0.1 to 0.5%,
Si: 0.01 to 0.7%,
Mn: 0.2 to 2.5%,
Al: 0.01 to 0.5%,
P: 0.001 to 0.1%,
S: 0.001 to 0.1%,
N: 0.0010% to 0.05%, and
a balance of Fe and unavoidable impurities.

(7) The hot stamped high strength part which is excellent in post painting anticorrosion property as set forth in the above (6) characterized in that the steel sheet further comprises, by mass %, one or more elements selected from
Cr: over 0.4 to 3%,
Mo: 0.005 to 0.5%,
B: 0.0001 to 0.01%,
W: 0.01 to 3%,
V: 0.01 to 2%,
Ti: 0.005 to 0.5%,
Nb: 0.01 to 1%
Ni: 0.01 to 5%,
Cu: 0.1 to 3%,
Sn: 0.005% to 0.1%, and
Sb: 0.005% to 0.1%.

(8) A method of production of an aluminum plated steel sheet for a hot stamped high strength part, comprising steps of:
providing an aluminum plated steel sheet obtained characterized by
hot rolling a steel which comprises chemical ingredients which comprise, by mass %,
C: 0.1 to 0.5%,
Si: 0.01 to 0.7%,
Mn: 0.2 to 2.5%,
Al: 0.01 to 0.5%,
P: 0.001 to 0.1%,
S: 0.001 to 0.1%,
N: 0.0010% to 0.05%, and
a balance of Fe and unavoidable impurities,
cold rolling said hot rolled steel to obtain a cold rolled steel sheet,
heating said cold rolled steel sheet on a hot dipping line to an annealing temperature of 670 to 760° C.,
holding said heated steel sheet in a reducing furnace for 60 sec or less, and
aluminum plating said steel sheet; and
temper rolling said aluminum plated steel sheet to give a rolling rate of 0.5 to 2%;
raising the temperature of said temper rolled aluminum plated steel sheet by a temperature elevation rate of 3 to 200° C./sec; hot stamping the aluminum plated steel sheet under conditions of a Larson-Miller parameter (LMP) expressed by the following formula:

$$LMP=T(20+\log t)$$

(wherein, T: heating temperature of aluminum plated steel sheet (absolute temperature K), t: holding time in heating furnace after reaching target temperature (hrs)) of 20000 to 23000; and
quenching said aluminum plated steel sheet after hot stamping at a 20 to 500° C./sec cooling rate in the die.

(9) The method of production of an aluminum plated steel sheet for a hot stamped high strength part as set forth in the above (8) characterized in that the steel furthermore comprises, by mass %, one or more of the elements selected from
Cr: over 0.4 to 3%,
Mo: 0.005 to 0.5%,
B: 0.0001 to 0.01%,
W: 0.01 to 3%,
V: 0.01 to 2%,
Ti: 0.005 to 0.5%,
Nb: 0.01 to 1%
Ni: 0.01 to 5%,
Cu: 0.1 to 3%,
Sn: 0.005% to 0.1%, and
Sb: 0.005% to 0.1%.

(10) The method of production of an aluminum plated steel sheet for a hot stamped high strength part as set forth in the above (8) or (9) characterized in that in the temperature elevation rate in the hot stamping step is 4 to 200° C./sec.

(11) The method of production of an aluminum plated steel sheet for a hot stamped high strength part as set forth in any one of above (8) to (10) characterized in that in the step of producing the aluminum plated steel sheet, a plating bath for aluminum plating comprises Si in an amount of 7 to 15%, and either a bath temperature or a sheet temperature upon entering the bath is 650° C. or less.

Advantageous Effects of Invention

According to the present invention, it is possible to arrest cracks which had formed in the plating layer (alloy layer) of aluminum plated steel sheet at the time of hot stamping without allowing propagation at the crystal grain boundaries of the plating layer. For this reason, cracks do not reach the surface of the hot stamped high strength part and the hot stamped high strength part can be improved in post painting anticorrosion property. Further, in the present invention, the surface of the plating layer of the aluminum plated steel sheet is further formed with a lubricating surface film layer which contains ZnO and then the sheet is hot stamped to obtain the shaped part. Due to this, it is possible to improve the workability at the time of hot stamping and possible to suppress the formation of cracks, so the productivity can be raised. Furthermore, by reducing the deviation of the plating thickness, the spot weldability can be stabilized. Further, by using a steel sheet having the steel ingredients of the present invention, it is possible to obtain a hot stamped high strength part which has a 1000 MPa or more tensile strength.

DESCRIPTION OF EMBODIMENTS

Figure 1:
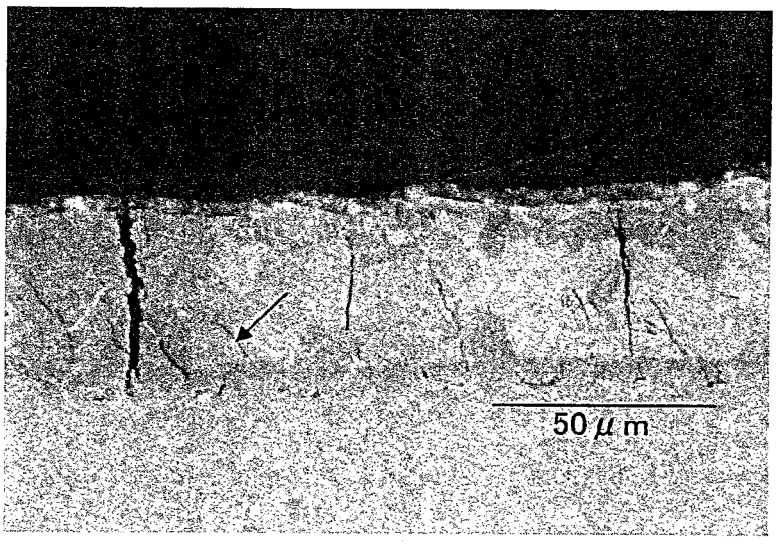
FIG. 1 is a polarization micrograph of the structure of an aluminum plating layer at the cross-section of a hot stamped part.

The hot stamped part of the present invention is made a high strength part by plating the surface of steel sheet with Al, heat treating the obtained aluminum plated steel sheet to make the aluminum plating layer form an alloy down to the surface, and then hot stamping it.

The method of aluminum plating in the aluminum plated steel sheet for hot stamped member use which is used in the present invention is not particularly limited. For example, the hot dipping method, first and foremost, and also the electroplating method, vacuum deposition method, cladding method, etc. may be used, but currently the plating method which is most prevalent industrially is the hot dipping method. This method is desirable. Usually, in aluminum plating of steel sheet, an aluminum plating bath which contains 7 to 15 mass % of Si can be used, but Si need not necessarily be contained. Si acts to suppress the growth of the alloy layer of the aluminum plating at the time of plating. If limited to hot stamping applications, there is little need to suppress growth of the alloy layer, but in the hot dipping method, a single bath is used to produce products for various applications, so in applications where workability of the aluminum plating is demanded, alloy layer growth has to be suppressed, so Si is usually included. In the present invention, the amount of Si which is contained in the aluminum plating layer before the aluminum plating layer becomes alloyed, as explained later, is the factor which governs the mean linear intercept length of the Al—Fe alloy. In the present invention, the aluminum plating bath preferably includes Si: 7 to 15%. By heating the aluminum plating layer to make it become alloyed at the time of hot stamping, Fe diffuses from the steel sheet material into the plating layer and the concentration of Si in the Al—Fe falls compared with the inside of the aluminum plating layer before hot stamping. If the aluminum plating bath contains 7 to 15% of Si, the Al—Fe alloy layer after hot stamping contains Si in an amount of 2 to 7%.

The steel sheet in the hot stamped high strength part of the present invention has an Al—Fe alloy layer formed by alloying of the aluminum plating at the surface due to annealing at the time of hot stamping. This Al—Fe alloy layer has an average value of thickness of 10 to 50 μm. If the thickness of this Al—Fe alloy layer is 10 μm or more, after the heating step, sufficient post painting anticorrosion property cannot be secured by the aluminum plated steel sheet for rapidly heated hot stamped member use. The greater the thickness, the better in terms of the corrosion resistance, but the greater the thickness of the Fe—Al alloy layer, the easier it is for the surface layer to drop off at the time of hot stamping, so the upper limit of the average value of thickness is made 50 μm or less.

Further, deviation in the thickness of the Al—Fe alloy layer of a hot stamped high strength part affects the stability of spot weldability. According to studies of the inventors, the thickness of the Al—Fe alloy layer affects the spattering current value. The smaller the deviation in thickness, the lower the spattering current as a general trend. For this reason, if the deviation in thickness of the Al—Fe alloy layer is large, the spattering current value easily varies and as a result the range of suitable welding current becomes smaller. Therefore, it is necessary to suitably control the deviation in thickness of the Al—Fe alloy layer. It was learned that it was necessary to make the ratio of the average value of thickness to the standard deviation of thickness (standard deviation of thickness/average value of thickness) of the Al—Fe alloy plating layer 0.15 or less. More preferably, the ratio is 0.1 or less. By doing this, stable spot weldability is obtained.

The thickness of the Al—Fe alloy plating layer of a hot stamped high strength part was measured and the standard deviation of thickness was calculated by the following procedure. First, steel was hot rolled, then cold rolled and was coated with Al by a hot dipping line. The entire width of the steel sheet was heated and quenched. After that, at positions 50 mm from the two edges in the width direction, the center of width, and intermediate positions of the positions 50 mm from the two edges and the center, a total of five locations, 20×30 mm test pieces were sampled. The test pieces were cut, the cross-sections were examined, and the thicknesses at the front and back were measured. At the cross-sections of the test pieces, any 10 points were measured for thickness. The average value of thickness and the standard deviation of thickness were calculated. In the measurement of the thickness at this time, each cross-section was polished, then was etched by 2 to 3% Nital to clarify the interface between the Al—Fe alloy layer and the steel sheet and measure the thickness of the alloy plating layer.

When the aluminum plating layer of the aluminum plated steel sheet before hot stamping contains Si, the layer is comprised of the two layers of the Al—Si layer and Fe—Al—Si layer in order from the surface layer. If this Al—Si layer is heated in the hot stamping step to 900° C. or so, Fe diffuses from the steel sheet, the plating layer as a whole changes to a layer of Al—Fe compound, and a layer which partially contains Si in the Al—Fe compound is also formed.

It is known that when heating aluminum plated steel sheet to alloy the aluminum plating layer before hot stamping, the Fe—Al alloy layer generally usually has a five-layer structure. Among these five layers, in order from the coated steel sheet surface layer, the first layer and the third layer mainly comprise $Fe_2Al_5$ and $FeAl_2$. In those layers, the concentrations of Al are approximately 50 mass %. The concentration of Al in the second layer is approximately 30 mass %. The fourth layer and the fifth layer can be judged to be layers corresponding to FeAl and aFe. The concentrations of Al in the fourth layer and the fifth layer are respectively 15 to 30 mass % and 1 to 15 mass %, that is, broad ranges in the compositions. The balance was Fe and Si in each layer. These alloy layers had corrosion resistances substantially dependent on the Al content. The higher the Al content, the better the corrosion resistance. Therefore, the first layer and the third layer are the best in corrosion resistance. Note that, below the fifth layer is the steel sheet martensite. This is a hardened structure mainly comprised of martensite. Further, the second layer is a layer which contains Si which cannot be explained from the Fe—Al binary phase diagram. The detailed composition is not clear. The inventors guess that this is a phase where $Fe_2Al_5$ and Fe—Al—Si compounds are finely mixed.

When rapidly heating and hot stamping such aluminum plated steel sheet, the structure of the obtained Al—Fe alloy layer, while depending on the heating conditions at the time of hot stamping, does not exhibit such a clear five-layer structure. This believed because since rapid heating is involved, the amount diffusion of Fe into the plating layer is small.

The Al—Fe alloy layer is formed by the diffusion of the Fe in the steel sheet material into the aluminum plating, so has a distribution of concentration where the concentration of Fe is high and the concentration of Al is low at the steel sheet side of the aluminum plating layer and, further, the concentration of Fe falls and the concentration of Al rises toward the surface side of the plating layer.

If examining the aluminum plating layer of a hot stamped part, since the Al—Fe alloy phase is hard and brittle, cracks form in the plating layer of the hot stamped part. FIG. 1 is a polarization micrograph of the structure of an aluminum plating layer at the cross-section of a hot stamped part. As shown in FIG. 1, it is learned that large cracks run through the crystal grains and reach the matrix, so small cracks are arrested at the crystal grain boundaries (shown by arrow).

Therefore, the inventors took note of the phenomenon of cracks being arrested at the crystal grains boundaries and studied in depth the arrest of propagation of cracks which form at the aluminum plating layer. As a result, they discovered that by controlling, among the crystal grains of the plurality of intermetallic compound layers mainly comprised of Al—Fe which are formed at the surface of the steel, the average intercept layer of the crystal grains of an intermetallic compound layer which contains Al: 40 to 65% to 3 to 20 μm in range, it is possible to arrest the propagation of cracks which form at the aluminum plating layer. As explained below, the "mean linear intercept length" referred to here means the length measured in a direction parallel to the surface of the steel sheet. Here, the alloyed aluminum plating naturally is mainly comprised of Al and Fe, but the aluminum plating also contains Si, so it is mainly comprised of Al—Fe and contains a small amount of Al—Fe—Si.

The inventors studied the dominating factors which affect the mean linear intercept length of a phase which contains Al: 40 to 65%, whereupon they found that the mean linear intercept length of a phase which contains Al: 40 to 65% is greatly affected by the plating thickness, the heat history (temperature elevation rate and holding time), the aluminum plating conditions (amount of Si, bath temperature, and sheet temperature when dipped) and other manufacturing conditions of hot stamped high strength parts. Specifically, the effect of the type of alloy layer after aluminum plating is particularly large. The heat history can be controlled by using the Larson-Miller parameter (LMP) which is explained below.

To reduce the mean linear intercept length of a phase which contains Al: 40 to 65% after alloying to a finer 3 to 20 μm, it is preferable to form β-AlFeSi as the initial alloy layer at the time of aluminum plating. β-AlFeSi is a compound which has a monoclinic crystal structure and is also said to have a composition of $Al_5FeSi$. Furthermore, to form β-AlFeSi as the alloy layer after aluminum plating, it is effective to make the amount of Si in the bath 7 to 15% and the bath temperature 650° C. or less or to make the bath temperature 650 to 680° C. and the sheet temperature upon entry 650° C. or less. This is because at the Si concentration and temperature of this region, β-AlFeSi becomes a stable phase.

Figure 2:
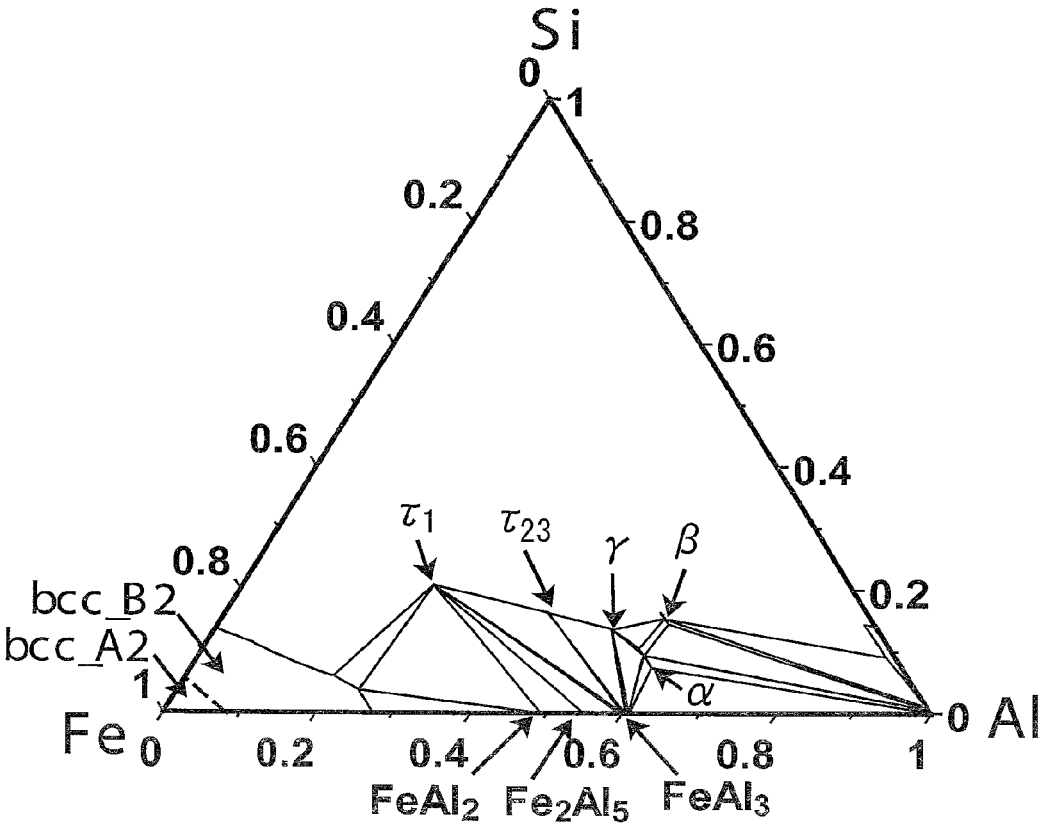
FIG. 2 is an Al—Fe—Si ternary phase diagram (650° C. isotherm).

The reason why the mean linear intercept length of a phase which contains
Al: 40 to 65% becomes small when forming β-AlFeSi as an alloy layer after aluminum plating can be deduced from the Al—Fe—Si ternary phase diagram which is shown in FIG. 2. A phase which contains Al: 40 to 65% is believed to be a phase which mainly comprises $Fe_2Al_5$. The phase of a compound in an alloy layer which is formed by aluminum plating is a phase which balances with a liquid phase of Al—Si and can take three forms of an α-phase, β-phase, and $FeAl_3$-phase. For example, when an $FeAl_3$ phase is formed, if Fe diffuses in this compound, it is believed that the $FeAl_3$ phase transforms to an $Fe_2Al_5$ phase. As opposed to this, for the β-phase to be transformed in phase to $Fe_2Al_5$, it is necessary to go through numerous transformations such as β-phase→α-phase→$FeAl_3$ phase→$Fe_2Al_5$ phase. By going through the transformations, crystal grains are formed again, so the greater the transformations which are gone through, the smaller the mean linear intercept length tends to become. That is, the mean linear intercept length becomes smaller with the α-phase than the $FeAl_3$ phase and with the β-phase than the α-phase.

Figure 3:
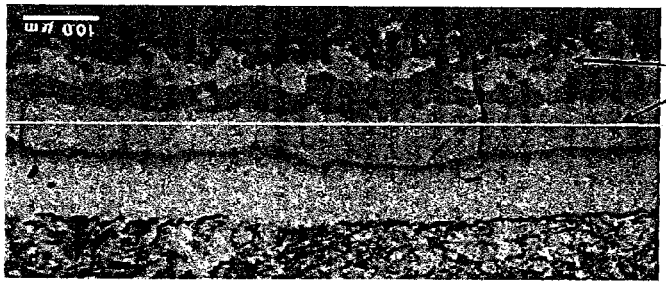
FIGS. 3(*a*) to (*d*) are polarization micrographs of the structure of an aluminum plating layer. (a) shows the case of a plating thickness of 40 g/m per side and a temperature elevation rate at hot stamping of 5° C. (b) shows the case of a plating thickness of 40 g/m per side and a temperature elevation rate at hot stamping of 20° C. (c) shows the case of a plating thickness of 80 g/m per side and a temperature elevation rate at hot stamping of 5° C. (d) shows the case of a plating thickness of 80 g/m per side and a temperature elevation rate at hot stamping of 20° C. Further, (a) is a view which shows the method of finding the mean linear intercept length of crystal grains by the line segment method. It is a view which shows the mean linear intercept length found by drawing a line parallel to the plating layer surface, counting the number of grain boundaries which are passed by through this line, and dividing the measured length by the number of grain boundaries. In (a), the mean linear intercept length was 12.3 μm.
Figure 3:
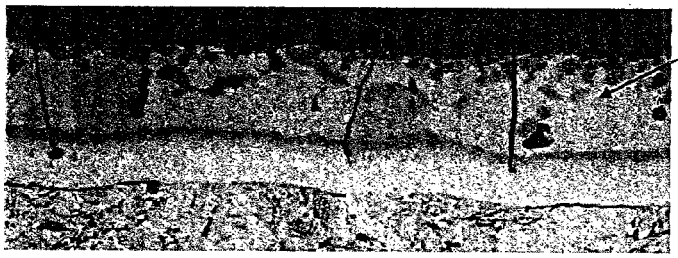
Figure 3:
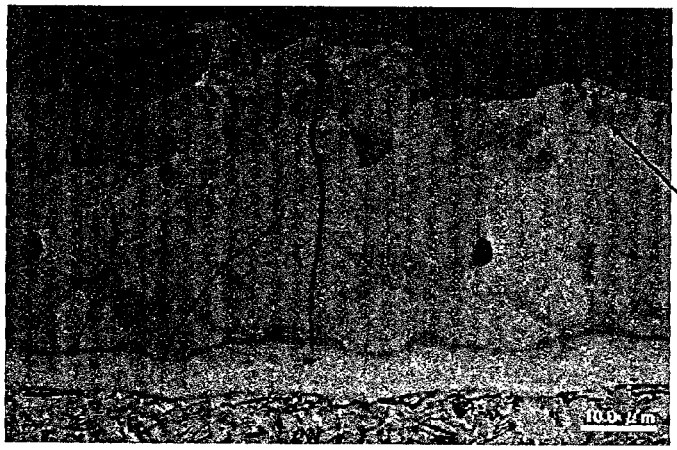
Figure 3:
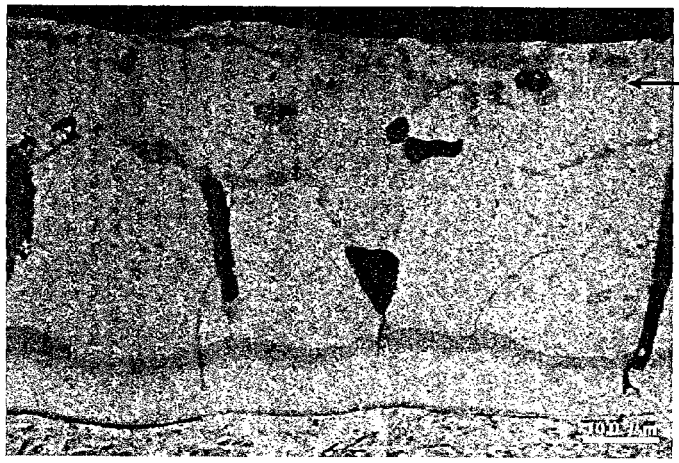

The method of measurement of a mean linear intercept length in an alloy plating layer is to polish any cross-section of a hot stamped part, then etch it by 2 to 3 vol % of Nital and examine the result by a microscope. For the examination, a polarization microscope is used. The polarization angle is adjusted so that the contrast of the crystal grains becomes the clearest. At this time, the layer of a compound whose contrast appears light at the surface layer side consecutively from the layer of a compound whose contrast appears dark is a phase of Al: 40 to 65%. This phase is a phase which has the property of arresting the crack propagation and is a phase which affects the post painting anticorrosion property and the plating workability. As shown in FIGS. 3(*a*) to (*b*), in particular when the plating thickness is thin (40 g/$m^2$ per side), due to the effect of the dark contrast phase, the mean linear intercept length of Al: 40 to 65% phase is difficult to measure. Therefore, in this Description, the mean linear intercept length of the crystal grains in the alloy plating layer is defined as the mean linear intercept length which is measured in the direction parallel to the steel sheet surface. The mean linear intercept length is found by the line segment method. As shown in FIG. 3(*a*), the mean linear intercept length is found by drawing a line parallel to the steel sheet surface in the plating layer, counting the number of grain boundaries which this line passes through, and dividing the measured length by the number of grain boundaries. It is possible to calculate the grain size from this mean linear intercept length, but calculation of the grain size requires that the shape of the grains be known. In steel sheet, crystal grains can be assumed to be spherical, but the intermetallic compounds which are formed at the surface like in the present invention are unknown in crystal grain shape, so the mean linear intercept length was used.

Figure 5:
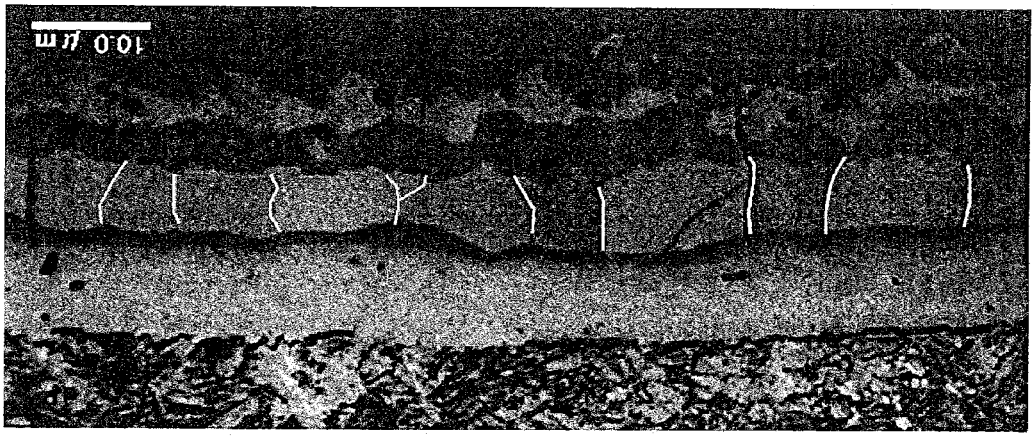
FIG. 5 is a polarization micrograph of the structure of the aluminum plating layer of FIG. 3 wherein the grain boundaries of the crystal grains are traced to clearly show them.
Figure 5:
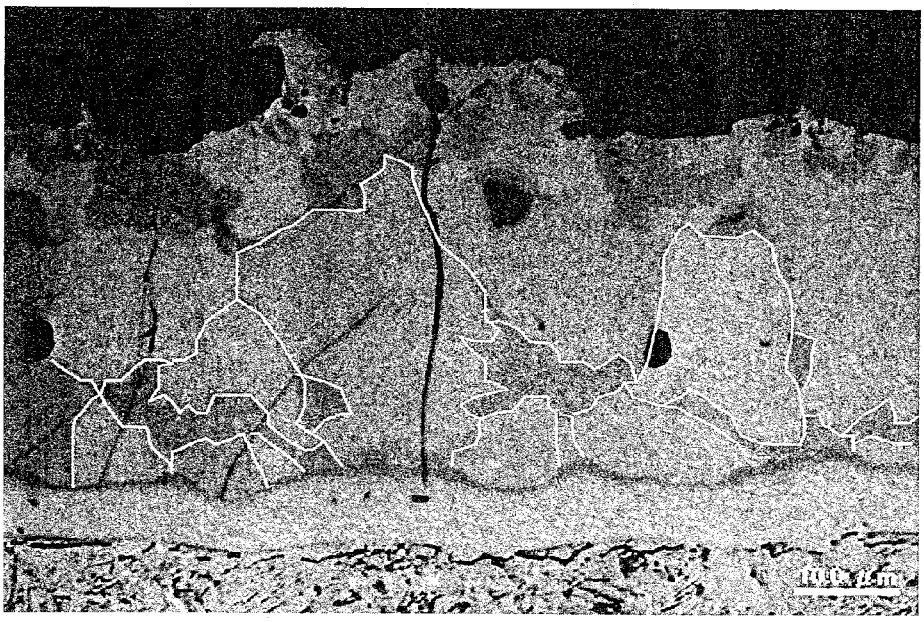

Note that, in actual measurement, in the polarization micrographs of FIGS. 3(*a*) to (*d*), the grain boundaries are unclear, so as shown in FIGS. 5(*a*) and (*b*), the crystal grain boundaries were traced in the polarization micrographs of FIGS. 3(*a*) and (*c*) to clarify the crystal grain boundaries.

The reason for limiting the mean linear intercept length of a phase which contains Al: 40 to 65% after the aluminum plating layer is alloyed to 3 to 20 μm will be explained. A small grain size is preferable as a crack propagation arrest property of a phase which contains Al: 40 to 65%, but the steel sheet for hot stamping member use has to be heated once to the austenite region. For this reason, this steel sheet is generally heated to 850° C. or more, so the aluminum plating layer which is alloyed in this heating step ends up with crystal grains growing to 3 μm or more. Therefore, usually making the crystal grain size less than 3 μm is extremely difficult. If the mean linear intercept length exceeds 20 μm and the grain size becomes larger, the aluminum plating layer falls in workability and the phenomenon of powdering becomes greater. Furthermore, the crack propagation arrest property of a phase which contains Al: 40 to 65% no longer functions and cracks can no longer be arrested by the crystal grains.

Therefore, in the present invention, the mean linear intercept length of a phase which contains Al: 40 to 65% was limited to 3 to 20 μm, preferably it is 5 to 17 μm.

Next, the effects of the aluminum plating conditions and heating conditions at the time of hot stamping on the mean linear intercept length will be explained.

Figure 4:
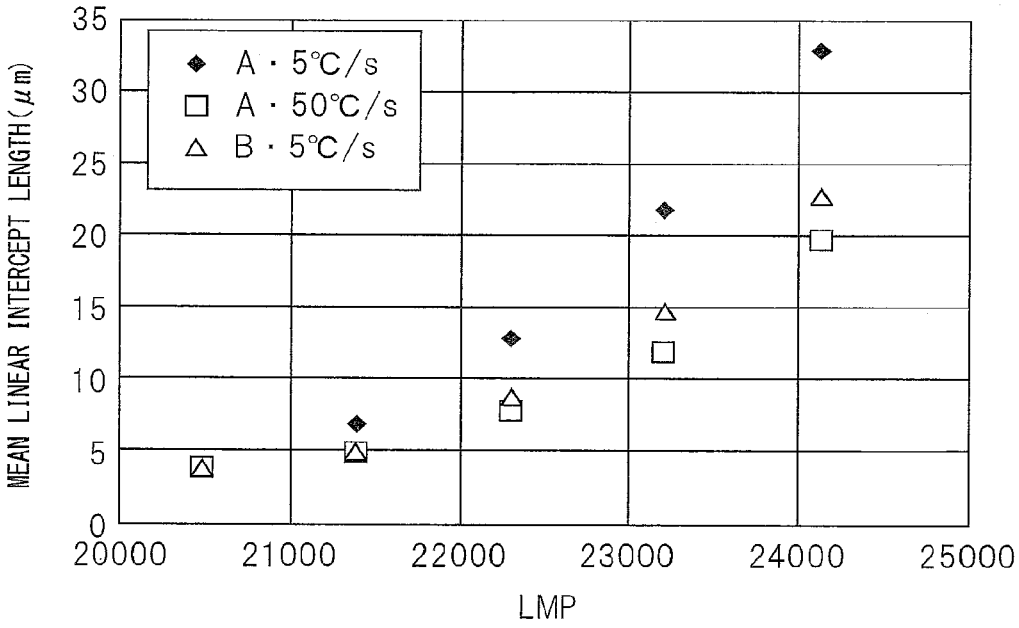
FIG. 4 is a view which shows the effects of the aluminum plating conditions and heating conditions at the time of hot stamping on the mean linear intercept length of an intermetallic compound phase which contains Al: 40 to 65%. The abscissa shows the Larson-Miller parameter (LMP) of the heating conditions at the time of hot stamping.

FIG. 4 is a view which shows the effects of the aluminum plating conditions and the heating conditions at the time of hot stamping on the mean linear intercept length. In FIG. 4, the abscissa shows the Larson-Miller parameter (LMP) of the heating conditions at the time of hot stamping.

The Larson-Miller parameter (LMP) is expressed by $$LMP=T(20+\log t)$$

(wherein, T: absolute temperature (K), t: time (hrs)). Here, T is the heating temperature of the steel sheet, while "t" is the holding time in the heating furnace after reaching the target temperature. LMP is an indicator which is used in general for treating the temperature and time in a unified manner in heat treatment and phenomena such as creep where the temperature and time have an effect. This parameter can also be used for the growth of crystal grains. In the present invention, LMP summarizes the effects of temperature and time on the mean linear intercept length of crystal grains, so the heat treatment conditions at the time of hot stamping can be described by just this parameter.

The symbols which are described in FIG. 4 will be explained. A and B show aluminum plating conditions. A means a 7% Si bath of a bath temperature of 660° C., while B means a 11% Si bath of a bath temperature of 640° C. These are typical conditions whereby an α-AlFeSi phase and a β-AlFeSi phase are produced at the time of aluminum plating. Further, "5° C./s" and "50° C./s" mean the temperature elevation rates at the time of hot stamping. 5° C./s corresponds to usual furnace heating, while 50° C./s corresponds to infrared heating, ohmic heating, and other rapid heating. Here, the "temperature elevation rate" means the average temperature elevation rate from the start of temperature elevation to a temperature 10° C. lower than the target temperature. If comparing the aluminum plating conditions A and B, the trend is that forming an α-AlFeSi phase at the time of the conditions A, that is, aluminum plating, gives a mean linear intercept length greater than the conditions B. It was learned that it is necessary to limit the range of heating conditions at the time of hot stamping to a narrower range (LMP=20000 to 23000). If the LMP is less than 20000, the diffusion of the Al—Si plating layer with the steel sheet is insufficient and an unalloyed Al—Si layer remains, so this is not preferred. Further, in the plating conditions A of FIG. 4, comparing the temperature elevation rates of 5° C./sec and 50° C./sec, it is shown that even with such a narrow range, if increasing the temperature elevation rate at the hot stamping, the structure becomes finer. The temperature elevation rate is preferably 4 to 200° C./sec(s) in range. If the temperature elevation rate is slower than 4° C./sec, this means that the heating step takes time and means that the hot stamping falls in productivity. Further, if faster than 200° C./sec, control of the temperature distribution in the steel sheet becomes difficult. Both are not preferred. Establishing suitable aluminum plating conditions and hot stamping conditions enables the mean linear intercept length to be made 3 to 20 μm.

As explained above, by making the mean linear intercept length of the crystal grains of a phase containing Al: 40 to 65% in the layer of the intermetallic compounds mainly comprised of Al—Fe which is formed at the surface of the steel 3 to 20 μm, it is possible to arrest the propagation of cracks which form at the plating layer due to hot stamping inside the plating layer. Due to this, it is possible to suppress corrosion of the steel sheet matrix due to cracks in the plating layer and possible to obtain high strength auto parts which are excellent in post painting anticorrosion property and other hot stamped parts.

The hot stamped high strength parts of the present invention further may have a surface film which contains ZnO at the surface of the alloy plating layer mainly comprised of Al—Fe.

The hot stamped high strength part of the present invention has the extremely hard Al—Fe intermetallic compounds formed at the plating layer of the steel sheet surface at the time of hot stamping. For this reason, working defects are formed at the surface of the shaped part due to contact with the die at the time of press forming in the hot stamping. There is the problem that these working defects because the cause of cracks in the plating layer. The inventors discovered that by forming a surface film which has excellent lubricity at the surface of the aluminum plating layer, it is possible to suppress the working defects of a shaped part and the occurrence of cracks in the plating layer and discovered that it is possible to improve the formability at the time of hot stamping and the corrosion resistance of a shaped part.

The inventors engaged in intensive studies on a surface film which has lubricity which is suitable for hot stamping and as a result discovered that providing the surface of the aluminum plating layer with a lubricating surface film layer which contains ZnO (zinc oxide), it is possible to effectively prevent working defects of the shaped part surface and cracks in the plating layer.

ZnO is included in the surface film layer at one side of the aluminum plated steel sheet in an amount, converted to mass of Zn, of 0.3 to 7 g/m$^2$. More preferably, it included in 0.5 to 4 g/m$^2$. If the content of ZnO is, converted to mass of Zn, 0.1 g/m$^2$ or more, the effect of improvement of the lubricity and effect of prevention of segregation (effect of enabling uniform thickness of aluminum plating layer) etc. can be effectively exhibited. On the other hand, when the content of ZnO exceeds, converted to mass of Zn, 7 g/m$^2$, the total thickness of the aluminum plating layer and surface film layer becomes too thick and the weldability or painting adhesion falls.

Figure 6:
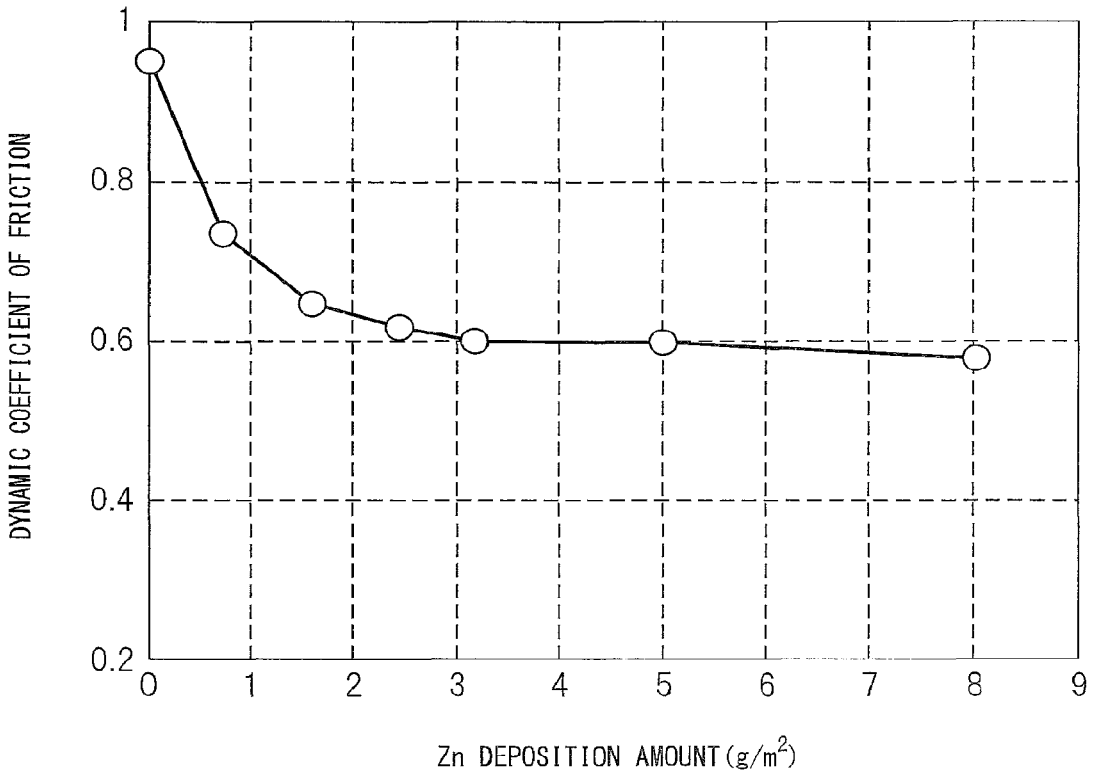
FIG. 6 is a view which shows the relationship between the amount of deposition of Zn on the aluminum plated steel sheet surface and the dynamic coefficient of friction.

FIG. 6 is a view which shows the relationship between the amount of deposition of Zn on the aluminum plated steel sheet surface and the coefficient of dynamic friction. The content of ZnO in the surface film layer was changed to evaluate the lubricity at the time of hot stamping. This lubricity was evaluated by the following test. First, different test materials of the aluminum plated steel sheet which has an ZnO film layer (150×200 mm) were heated to 900° C., then were cooled down to 700° C. The test materials were subjected to loads from above through steel balls. Further, the steel balls were slid out over the test materials. At this time, the pullout load was measured by a load cell. The ratio of the pullout load/push-in load was made the coefficient of dynamic friction. The results are shown in FIG. 6. If the coefficient of dynamic friction is smaller than 0.65, it is evaluated as good. It is learned that in a region where the amount of deposition of Zn is generally 0.7 g/m$^2$ or more, the coefficient of dynamic friction is effectively kept low and the hot lubricity can be improved.

A surface film layer which contains ZnO can be formed, for example, by applying a paint which contains ZnO and baking or drying it after applying for curing so as to enable formation over the aluminum plating layer. As the method of applying a ZnO paint, for example, the method of mixing a predetermined organic binder and a dispersion of ZnO powder and applying it to the surface of the aluminum plating layer, a method of painting by powder painting, etc. may be mentioned. As the method of baking and drying after applying, for example, a hot air furnace, induction heating furnace, near infrared ray furnace, or other method or a method combining the same may be mentioned. At this time, depending on the type of the binder which is used for applying, instead of baking and drying after applying, for example, curing by ultraviolet rays or electron beams etc. is possible. As the predetermined organic binder, for example, a polyurethane resin or polyester resin etc. may be mentioned. However, the method of forming the ZnO surface film layer is not limited to these examples and can be formed by various methods.

Such a surface film layer which contains ZnO can improve the lubricity of an aluminum plated steel sheet at the time of hot stamping, so working defects of the plating layer and cracks in the plating layer at the surface of the shaped part can be suppressed.

ZnO has a melting point of approximately 1975° C. or higher compared with the aluminum plating layer (the melting point of aluminum is approximately 660° C.) etc. Therefore, even when working steel sheet at for example 800° C. or more such as when working a coated steel sheet by the hot stamping method etc., the surface film layer which contains this ZnO will not melt. Therefore, even if heating of the aluminum plated steel sheet causes the aluminum plating layer to melt, the state where the ZnO surface film layer covers the aluminum plating layer to be maintained, so it is possible to prevent the thickness of the melted aluminum plating layer from becoming uneven. Note that, uneven thickness of the aluminum plating layer of a hot stamped high strength part easily occurs, for example, in the case of heating by a furnace where the blank is oriented vertically with respect to the direction of gravity or the case of heating by ohmic heating or induction heating. However, this surface film layer can prevent uneven thickness of the aluminum plating layer when such heating is performed and enables aluminum plating layer to be formed thicker.

In this way, an ZnO surface film layer exhibits the effects of improving the lubricity and making the thickness of the aluminum plating layer uniform etc. so can improve the formability at the time of press forming in hot stamping and the corrosion resistance after press forming.

Further, the aluminum plating layer can be made uniform in thickness, so can be rapidly heated by ohmic heating or induction heating enabling a higher temperature elevation rate. This is effective for making the mean linear intercept length of the crystal grains of an intermetallic compound phase which contains Al: 40 to 6 5 mass % 3 to 20 μm.

Furthermore, this ZnO surface film layer never causes a drop in the spot weldability, paint adhesion, post painting anticorrosion property, and other performance. The post painting anticorrosion property is rather further improved by imparting a surface film layer.

Next, the inventors studied the composition of ingredients for steel sheet for obtaining the aluminum plated steel sheet for rapidly heated hot stamped member use provided with both excellent corrosion resistance and excellent productivity. As a result, since the hot stamping was performed with the pressing and quenching simultaneously by the die, they obtained the ingredients for the steel sheet which are explained below from the viewpoint of the aluminum plated steel sheet for hot stamped member use containing ingredients enabling easy quenching and thereby giving hot stamped parts which have a 1000 MPa or more high strength after hot stamping.

Below, the reasons for limiting the ingredients of the steel sheet in the present invention will be explained. Note that, the % of the ingredients mean mass %.

C: 0.1 to 0.5%

The present invention provides a hot stamped part which has a 1000 MPa or more high strength after shaping. To obtain high strength, the steel has to be rapidly cooled after hot stamping to transform it to a structure of mainly martensite. From the viewpoint of improvement of the hardenability, an amount of C of at least 0.1% is necessary. On the other hand, if the amount of C is too great, the toughness of the steel sheet remarkably falls, so the workability falls. For this reason, the amount of C is preferably 0.5% or less.

Si: 0.01 to 0.7%

Si promotes a reaction between the Al and Fe in the plating and has the effect of raising the heat resistance of the aluminum plated steel sheet. However, Si forms a stable oxide film during the recrystallization annealing of the cold rolled steel sheet at the steel sheet surface, so is an element which obstructs the properties of the aluminum plating. From this viewpoint, the upper limit of the amount of Si is made 0.7%. However, if making the amount of S less than 0.01%, the fatigue property deteriorates, so this is not preferable. Therefore, the amount of Si is 0.01 to 0.7%.

Mn: 0.2 to 2.5%

Mn is well known as an element which raises the hardenability of steel sheet. Further, it is also an element which is necessary for preventing hot embrittlement due to the unavoidably entering S. For this reason, 0.2% or more has to be added. Further, Mn raises the heat resistance of steel sheet after aluminum plating. However, if over 2.5% of Mn is added, the part which is hot stamped after quenching falls in impact properties, so 2.5% is made the upper limit.

Al: 0.01 to 0.5%

Al is suitable as a deoxidizing element, so 0.01% or more may be included. However, if included in a large amount, coarse oxides are formed and the mechanical properties of the steel sheet are impaired, so the upper limit of the amount of Al is made 0.5%.

P: 0.001 to 0.1%

P is an impurity element which is unavoidably included in steel sheet. However, P is a solution strengthening element. It can raise the strength of the steel sheet relatively inexpensively, so the lower limit of the amount of P was made 0.001%. However, if recklessly increasing the amount of addition, the toughness of the high strength material is lowered and other detrimental effects appear, so the lower limit of the amount of P was made 0.1%.

S: 0.001 to 0.1%

S is an unavoidably included element. It forms inclusions of MnS in the steel. If the MnS is large in amount, the MnS forms starting points of fracture, obstructs ductility and toughness, and becomes a cause of deterioration of workability. Therefore, the amount of S is preferably as low as possible. The upper limit of the amount of S was made 0.1% or less, but reducing the amount of S more than necessary is not preferable from the viewpoint of manufacturing costs, so the lower limit was made 0.001%.

N: 0.0010% to 0.05%

N easily bonds with Ti or B, so has to be controlled so as not to decrease the effects targeted by these elements. An amount of N of 0.05% or less is allowable. Preferably, the amount of N is 0.01% or less. On the other hand, reduction more than necessary places a massive load on the steelmaking step, so 0.0010% should be made the target for the lower limit of the amount of N.

Next, the ingredients which can be selectively contained in the steel will be explained.

Cr: over 0.4% to 3%

Cr is also an element which generally raises the hardenability. It is used in the same way as Mn, but also has a separate effect when applying an aluminum plating layer to steel sheet. If Cr is present, for example, when box annealing the steel after applying the aluminum plating layer so as to alloy the aluminum plating layer, the plating layer and the steel sheet matrix easily alloy with each other. When box annealing the aluminum plated steel sheet, AlN is formed in the aluminum plating layer. AlN suppresses the alloying of the aluminum plating layer and leads to peeling of the plating, but addition of Cr makes formation of AlN difficult and makes alloying of the aluminum plating layer easier. To obtain these effects, the amount of Cr is over 0.4%. However, even if adding Cr in an amount of over 3%, the effect becomes saturated. Further, the cost also rises. In addition, the aluminum plating property falls. Therefore, the upper limit of the amount of Cr is 3%.

Mo: 0.005 to 0.5%

Mo, like Cr, has the effect of suppressing the formation of AlN, which causes peeling of the plating layer, formed at the interface of the plating layer and the steel sheet matrix when box annealing the aluminum plating layer. Further, it is a useful element from the viewpoint of the hardenability of the steel sheet. To obtain these effects, an amount of Mo of 0.005% is necessary. However, even if adding over 0.5%, the effect becomes saturated, so the upper limit of the amount of Mo is 0.5%.

B: 0.0001 to 0.01%

B also is a useful element from the viewpoint of the hardenability of steel sheet and exhibits its effect at 0.0001% or more. However, even if adding over 0.01%, the effect becomes saturated and, further, casting defects and cracking of the steel sheet at the time of hot rolling occur etc. and the manufacturability otherwise drops, so the upper limit of the amount of B is 0.01%. Preferably, the amount of B is 0.0003 to 0.005%.

W: 0.01 to 3%

W is a useful element from the viewpoint of the hardenability of steel sheet and exhibits its effect at 0.01% or more. However, even if over 3% is added, the effect becomes saturated and, further, the cost also rises, so the upper limit of the amount of W is 3%.

V: 0.01 to 2%

V, like W, is a useful element from the viewpoint of the hardenability of steel sheet and exhibits its effect at 0.01% or more. However, even if V us added in an amount over 3%, the effect becomes saturated and, further, the cost also rises, so the upper limit of the amount of V is 2%.

Ti: 0.005 to 0.5%

Ti can be added from the viewpoint of fixing the N. By mass %, Ti has to be added in an amount of approximately 3.4 times the amount of N, but N, even if decreased, is present in 10 ppm or so, so the lower limit of the amount of Ti was made 0.005%. Further, even if excessively adding Ti, the hardenability of the steel sheet is caused to fall or the strength is also caused to fall, so the upper limit of the amount of Ti is 0.5%.

Nb: 0.01 to 1%

Nb, like Ti, can be added from the viewpoint of fixing the N. By mass %, Nb has to be added in an amount of approximately 6.6 times the amount of N, but N, even if decreased, is present in 10 ppm or so, so the lower limit of the amount of Nb was made 0.01%. Further, even if excessively adding Nb, the hardenability of the steel sheet is caused to fall or the strength is also caused to fall, so the upper limit of the amount of Nb is 1%, preferably 0.5%.

Further, as ingredients in a steel sheet, even if Ni, Cu, Sn, Sb, are further included, the effect of the present invention is not obstructed. Ni is a useful element from the viewpoint of not only the hardenability of steel sheet, but also the low temperature toughness which in turn leads to improvement of the impact resistance. It exhibits this effect at 0.01% or more of Ni. However, even if adding Ni in over 5%, the effect becomes saturated and the cost rises, so N may be added in the range of 0.01 to 5%. Cu is also a useful element from the viewpoint of not only the hardenability of steel sheet, but also the toughness. It exhibits this effect at 0.1% or more of Cu. However, even if adding Cu in over 3%, the effect becomes saturated and the cost rises. Not only that, deterioration of the slab properties and cracks and defects in the steel sheet at the time of hot rolling are caused, so Cu should be added in 0.01 to 3% in range. Furthermore, Sn and Sb are both elements which are effective for improving the wettability and bondability of the plating with respect to the steel sheet. An amount of 0.005% to 0.1% can be added. If both are amounts of less than 0.005%, no effect can be recognized, while if over 0.1% is added, defects easily are caused at the time of production and, further, a drop in toughness is caused, so the upper limits of the amount of Sn and the amount of Sb are 0.1%.

Further, the other ingredients are not particularly prescribed. Sometimes Zr, As, and other elements enter from the iron scrap, but if in the usual range, they do not affect the properties of the steel which is used for the present invention.

Next, the method of production of a hot stamped high strength part will be explained.

The aluminum plated steel sheet for hot stamped member use which is used in the present invention is produced by taking cold rolled steel sheet which has been obtained by hot rolling steel, then cold rolling it, and plating it on a hot dipping line with an annealing temperature of 670 to 760° C. and a furnace time in the reducing furnace of 60 sec or less to treat the steel sheet with aluminum plating which contains Si: 7 to 15%. It is effective to make the skin pass rolling rate after aluminum plating 0.1 to 0.5%.

The annealing temperature of the hot dipping line has an effect on the shape of the steel sheet. If the annealing temperature is raised, the steel sheet easily warps in the C direction. As a result, at the time of aluminum plating, the difference in plating coating deposition amounts at the center part of the steel sheet in the width direction and near the edges will easily become larger. From this viewpoint, the annealing temperature is preferably 760° C. or less. Further, if the annealing temperature is too low, the temperature of the sheet when being dipped in the aluminum plating bath falls too much and dross defects easily are caused, so the lower limit of the annealing temperature is 670° C.

The furnace time in the reducing furnace affects the aluminum plating properties. Si, Cr, Al, and other elements which oxidize more easily than Fe easily oxidize in the reducing furnace at the steel sheet surface and obstruct the reaction between the aluminum plating bath and the steel sheet. In particular, if the furnace time in the reducing furnace is long, this effect becomes remarkable, so the furnace time is preferably 60 sec or less. Note that the lower limit of the furnace time is not particularly defined, but 30 sec or more is preferable.

After the aluminum plating, for shape adjustment etc., the sheet is rolled by skin pass rolling, but the rolling rate at this time affects the alloying of the aluminum plating layer at the time of hot stamping. Due to the rolling, strain is introduced into the steel sheet and plating layer. This is believed to be a result of this. If the rolling rate is high, the alloy layer after hot stamping tends to become smaller in crystal grain size, but it is not preferable if the rolling rate is made too low since the alloy layer which is produced is given cracks. For this reason, the rolling rate is preferably made 0.1 to 0.5%.

Further, after the aluminum plating, box annealing can be performed to make the aluminum plating layer alloyed. At this time, to promote the alloying, the steel preferably is made to include Cr, Mo, etc. The box annealing is for example performed at 650° C. for 10 hours or so.

The thus obtained aluminum plated steel sheet can be rapidly heated in the subsequent hot stamping step by a 50° C./sec or more temperature elevation rate. Further, rapid heating is effective for making the mean linear intercept length of the crystal grains in a phase containing Al: 40 to 65% in the Al—Fe alloy layer 3 to 20 μm. The heating system is not particularly limited. The usual furnace heating or an infrared type of heating system using radiant heat may be used. Further, it is also possible to use ohmic heating or high frequency induction heating or another heating system using electricity which enables rapid heating by a temperature elevation rate of 50° C./sec or more.

The upper limit of the temperature elevation rate is not particularly defined, but when using the above ohmic heating or high frequency induction heating or other heating system, due to the performance of the systems, 300° C./sec or so becomes the upper limit.

Further, at this heating step, the peak sheet temperature is preferably made 850° C. or more. The peak sheet temperature is made 850° C. or more so as to heat the steel sheet to the austenite region and promote sufficient alloying of the aluminum plating layer up to the surface.

Next, the aluminum plated steel sheet in the heated state is hot stamped to a predetermined shape between a pair of top and bottom forming dies. After being formed, it is held stationary at the press bottom dead center for several seconds to quench it by cooling by contact with the forming dies and thereby obtain the hot stamped high strength part of the present invention.

The hot stamped part was welded, chemically converted, painted by electrodeposition, etc. to obtain the final product. Usually, cationic electrodeposition painting is used. The film thickness becomes 1 to 30 μm or so. After the electrodeposition painting, an intermediate painting, top painting, and other painting are sometimes also applied.

EXAMPLES

Below, examples will be used to explain the present invention in further detail.

Example 1

After the usual hot rolling step and cold rolling step, a cold rolled steel sheet of the steel ingredients such as shown in Table 1 (sheet thickness 1.4 mm) was covered by hot dip aluminum plating containing Si. For the hot dip aluminum plating, a nonoxidizing furnace-reducing furnace type of line was used. After the plating, gas wiping was used to adjust the plating coating deposition amount to a total for the two sides of 160 g/m$^2$, then the sheet was cooled. At this time, as the plating bath composition, there were (A): Al-7% Si-2% Fe, bath temperature 660° C., and (B): Al-11% Si-2% Fe, bath temperature 640° C. The plating bath conditions correspond to the phases at the aluminum plating conditions A and B of FIG. 4. It should be noted that the Fe in the bath is unavoidable Fe which is supplied from the plating equipment and strips in the bath. Further, the annealing temperature was made 720° C. and the furnace time in the reducing furnace was made 45 sec. The aluminum plated steel sheet was generally good in appearance with no nonplating defects etc.

The thus prepared test piece was evaluated for post painting anticorrosion property. The hot stamping was performed using a usual furnace heating means. The temperature elevation rate of the aluminum plated steel sheet was approximately 5° C./sec. A 250×300 mm large test piece was heated in the air. The piece was elevated in temperature over approximately 3 minutes, then was held for approximately 1 minute, then removed from the furnace and cooled down to approximately 700° C. in temperature, formed into a hat shape, and cooled in the die. At this time, the cooling rate was approximately 200° C./sec. As shown in Table 2, the heating temperature of the test piece was changed in various ways to control the structure of the aluminum plating layer after alloying.

The vertical wall part of the hat shaped part was cut out to 50×100 mm and evaluated for post painting anticorrosion property. The chemical conversion solution PB-SX35 made by Parkerizing used for chemical conversion, then the cationic electrodeposition paint Powernix 110 made by Nippon Paint was painted to give an approximately 20 μm thickness. After that, a cutter was used to cross-cut this film, then a composite corrosion test defined by the Society of Automobile Engineers of Japan (JASO M610-92) was performed for 180 cycles (60 days). The extent of blistering from a cross-cut (maximum blistering at the cross-cut (maximum blister width at one side) was measured. At this time, the blister width of general rust-proof steel sheet, that is, GA (hot dip galvannealed steel sheet) (amount of deposition of 45 g/m$^2$ at one side) was 5 mm.

The post painting anticorrosion property was evaluated as "very good" with a blister width of 4 mm or less, as "good" with a blister width of over 4 mm to 6 mm, and as "poor" with a blister width of over 6 mm.

Regarding evaluation of the spot weldability, this has to be performed by a flat sheet, so a 400×500 mm plate shaped die was used. The usual furnace heating means was used, 400×500 mm aluminum plated steel sheet was heated by a temperature elevation rate of approximately 5° C./sec in the air, the sheet was evaluated in temperature over approximately 3 minutes, then was held for approximately 1 minute, then was taken out of the furnace, cooled in the air down to approximately 700° C. in temperature, then quenched in the die. 30 mm of the two edges of the aluminum plated steel sheet, plated by Al on a hot dipping line, in the width direction were cut off. The rest was used for the tests. After hot stamping, the part was quenched, then a 30×50 mm weld test piece was cut out and measured for suitable weld current range by a pressure of 500 kgf and electrification for 10 cycles (60 Hz). At this time, the lower limit current was made 4√t ("t" is the sheet thickness), while the upper limit current was made the spattering. The upper limit current value-lower current value was made the suitable weld current range.

The spot weldability was evaluated as "good" when over the suitable weld current range 2 kA and "poor" when the suitable weld current range 2 kA or less.

Further, after Nital etching, the test piece was examined in cross-section and the average value of thickness, the standard deviation of thickness (deviation in plating thickness), and the ratio of the average value of thickness to the standard deviation of thickness (standard deviation/average) were found for the plating thickness. Further, the alloy layer structure was examined and the mean linear intercept length of the crystal grains of a phase which contains Al: 40 to 65 mass % was measured. At this time, the test piece was cut out from the flange part with little deformation at the hat shaped part.

Note that, the average value of plating thickness and the standard deviation of plating thickness were determined by sampling 20×30 mm test pieces at positions 50 mm from the two edges of the steel sheet in the width direction, the center, and intermediate positions between the positions 50 mm from the two edges and the center, that is, a total of five locations. The test pieces were cut, examined in cross-section, calculated for thickness at the front and back, measured for thickness at 10 points, and calculated for average value of thickness and standard deviation.

The aluminum plating conditions, hot stamping conditions, mean linear intercept length, average value of thickness, and results of evaluation of the post painting anticorrosion property and weldability are described in Table 2.

Further, simultaneously, the cross-sectional hardness was measured by a Vicker's hardness meter (load 1 kgf), but values of a hardness of 420 or more were obtained at all measured locations.

TABLE 1

| Steel ingredients (mass %) | | | | | | | | | |
|---|---|---|---|---|---|---|---|---|---|
| C | Si | Mn | Al | P | S | N | Ti | B | Cr |
| 0.22 | 0.19 | 1.24 | 0.04 | 0.02 | 0.014 | 0.005 | 0.02 | 0.003 | 0.12 |

hot stamped under the same conditions, but differences were observed in the obtained alloy layer structures (mean linear intercept lengths). Examples with large mean linear intercept lengths fell relatively in post painting anticorrosion property. The reason is believed to be the plating cracks.

That is, the invention examples were all excellent in post painting anticorrosion property and spot weldability, but in the comparative examples where the mean linear intercept lengths failed to satisfy the requirements of the present invention (Nos. 4, 5, 10), the post painting anticorrosion property was inferior. Samples plated with Al by the conditions of A were used for rapid heating and quenching in a flat plate die. The heating method used a near infrared heating furnace. The temperature elevation rate at that time was 50° C./sec. The peak sheet temperature and the holding conditions were also changed to investigate the structures of the plating layers at that time. The results and the results of Table 2 are summarized in FIG. 4. It is shown that the mean linear intercept length is dependent on the plating conditions and the heating conditions.

Example 2

Cold rolled steel sheets of the various steel ingredients (A to I) which are shown in Table 3 (sheet thickness 1 to 2 mm) were used for aluminum plating in the same way as in Example 1. In this example, the annealing temperature and the reducing furnace time at this time were changed. As the aluminum plating bath composition, by mass %, Si: 9% and Fe: 2% were contained. The bath temperature was 660° C. and the deposition after plating was adjusted by the gas wiping method to a total of the two surfaces of 160 g/m$^2$.

After this, a method similar to Example 1 was used to make the heating temperature at the time of hot stamping 950° C. for quenching. After that, the post painting anticorrosion property and the spot weldability were evaluated. The method of evaluation was the same as in Example 1. The Vicker's hardness was 420 or more in all cases.

TABLE 2

| No. | Plating conditions | Heating temp. (° C.) | Holding time (sec) | Plating thickness average (μm) | Plating thickness standard deviation | Standard deviation/ average | Mean linear intercept length (μm) | Post painting anticorrosion property | Spot weld-ability | Remarks |
|---|---|---|---|---|---|---|---|---|---|---|
| 1 | A | 850 | 60 | 28 | 2.2 | 0.08 | 4 | Good | Good | Inv. ex. |
| 2 | A | 900 | 60 | 33 | 2.4 | 0.07 | 7 | Very Good | Good | Inv. ex. |
| 3 | A | 950 | 60 | 37 | 2.1 | 0.06 | 13 | Very Good | Good | Inv. ex. |
| 4 | A | 1000 | 60 | 44 | 2.7 | 0.06 | 22 | Poor | Good | Comp. ex. |
| 5 | A | 1050 | 60 | 53 | 2.4 | 0.05 | 33 | Poor | Good | Comp. ex. |
| 6 | B | 850 | 60 | 28 | 2.3 | 0.08 | 4 | Good | Good | Inv. ex. |
| 7 | B | 900 | 60 | 32 | 2.3 | 0.07 | 5 | Very Good | Good | Inv. ex. |
| 8 | B | 950 | 60 | 35 | 2.5 | 0.07 | 9 | Very Good | Good | Inv. ex. |
| 9 | B | 1000 | 60 | 42 | 2.6 | 0.06 | 15 | Very Good | Good | Inv. ex. |
| 10 | B | 1050 | 60 | 50 | 2.4 | 0.05 | 23 | Poor | Good | Comp. ex. |

As shown by the results of evaluation of Table 2, test pieces of the aluminum plating conditions A and B were both

TABLE 3

| | Steel ingredients (mass %) | | | | | | | | | | | |
|---|---|---|---|---|---|---|---|---|---|---|---|---|
| | C | Si | Mn | Al | P | S | N | Ti | B | Cr | Mo | Others |
| A | 0.23 | 0.24 | 1.52 | 0.041 | 0.067 | 0.071 | 0.005 | 0.092 | 0.006 | — | — | |
| B | 0.21 | 0.39 | 0.33 | 0.041 | 0.009 | 0.053 | 0.003 | 0.033 | 0.0091 | 2.624 | 0.122 | |
| C | 0.24 | 0.03 | 2.49 | 0.038 | 0.032 | 0.018 | 0.004 | 0.099 | 0.0063 | 0.001 | 0.375 | |
| D | 0.36 | 0.63 | 1.81 | 0.013 | 0.071 | 0.053 | 0.005 | 0.089 | 0.0064 | 0.904 | 0.295 | W: 0.01 |
| E | 0.16 | 0.21 | 0.84 | 0.051 | 0.023 | 0.038 | 0.002 | 0.020 | 0.0017 | 2.3 | 0.233 | Ni: 0.04 |

TABLE 3-continued

| | Steel ingredients (mass %) | | | | | | | | | | | |
|---|---|---|---|---|---|---|---|---|---|---|---|---|
| | C | Si | Mn | Al | P | S | N | Ti | B | Cr | Mo | Others |
| F | 0.19 | 0.25 | 2.25 | 0.044 | 0.099 | 0.063 | 0.003 | 0.066 | 0.0026 | 2.156 | 0.255 | Cu: 0.02 |
| G | 0.19 | 0.75 | 1.232 | 0.067 | 0.069 | 0.055 | 0.004 | 0.026 | 0.005 | 2.604 | 0.032 | |
| H | 0.30 | 0.19 | 0.91 | 0.03 | 0.01 | 0.019 | 0.003 | — | — | — | — | |
| I | 0.17 | 0.20 | 0.85 | 0.052 | 0.021 | 0.028 | 0.002 | 0.021 | 0.0015 | 2.1 | — | Ni: 0.04<br>Sb: 0.01 |

TABLE 4

| No. | Steel | Sheet thickness (mm) | Annealing temp. (° C.) | Reducing furnace time (sec) | Plating thickness average (μm) | Plating thickness standard deviation | Standard deviation/ average | Mean linear intercept length (μm) | Post painting anticorrosion property | Spot weld-ability | Remarks |
|---|---|---|---|---|---|---|---|---|---|---|---|
| 1 | A | 1.2 | 740 | 40 | 28 | 2.5 | 0.09 | 12 | Very Good | Good | Inv. ex. |
| 2 | A | 1.6 | 740 | 50 | 29 | 3.1 | 0.11 | 12 | Very Good | Good | Inv. ex. |
| 3 | A | 2.0 | 740 | 55 | 29 | 3.7 | 0.13 | 12 | Very Good | Good | Inv. ex. |
| 4 | A | 2.0 | 760 | 55 | 29 | 4.5 | 0.16 | 12 | Very Good | Poor | Comp. ex. |
| 5 | B | 1.6 | 730 | 50 | 28 | 3.0 | 0.11 | 13 | Very Good | Good | Inv. ex. |
| 6 | C | 1.6 | 710 | 50 | 29 | 2.9 | 0.10 | 12 | Very Good | Good | Inv. ex. |
| 7 | D | 1.6 | 720 | 50 | 29 | 3.3 | 0.11 | 12 | Very Good | Good | Inv. ex. |
| 8 | E | 1.6 | 730 | 50 | 28 | 3.2 | 0.11 | 13 | Very Good | Good | Inv. ex. |
| 9 | F | 1.6 | 740 | 50 | 28 | 3.0 | 0.11 | 12 | Very Good | Good | Inv. ex. |
| 10 | G | 2.0 | 740 | 65 | 28 | 4.4 | 0.16 | 12 | Poor | Poor | Comp. ex. |
| 11 | H | 1.2 | 740 | 40 | 28 | 2.6 | 0.10 | 12 | Very Good | Good | Inv. ex. |
| 12 | I | 1.6 | 740 | 50 | 28 | 3.2 | 0.11 | 12 | Very Good | Good | Inv. ex. |

In Example 2, the ingredients of the steel used, the sheet thickness, and the aluminum plating bath components were changed. As shown by the results of evaluation of Table 4, a trend was observed where if the sheet thickness becomes larger, the standard deviation of the plating thickness becomes larger and, further, if the annealing temperature becomes higher, the standard deviation of the plating thickness becomes larger. If the standard deviation is large, the suitable weld current range is narrow and spattering was easily generated in spot welding. Further, in a system of ingredients with high Si such as the Steel Ingredients G, if the furnace time in the reducing furnace is long (65 sec), nonplating defects are deemed to occur and the post painting anticorrosion property fell.

That is, as shown by the results of evaluation of Table 4, the invention examples were all excellent in post painting anticorrosion property and spot weldability, but in a comparative example where the ratio of the average value of thickness to the standard deviation of thickness (standard deviation/average) exceeds 0.15 (No. 4), the spot weldability was inferior. Further, in a comparative example where the reducing furnace time was long and the standard deviation/average exceeded 0.15 (No. 10), both the post painting anticorrosion property and spot weldability were inferior.

Example 3

The aluminum plated steel sheets of Nos. 2 and 5 of Table 4 of Example 2 were box annealed to alloy the aluminum plating layers. At this time, No. 2 corresponded to the Steel Ingredients A and No. 5 to the Steel Ingredients B. These differed in the amounts of Cr in the steel. At this time, in No. 2 (Steel Ingredients A), at the time of box annealing, AlN was formed near the interface of the aluminum plating layer and the steel sheet and the aluminum plating layer could not be sufficiently alloyed. In No. 5 (Steel Ingredients B), alloying was possible. Using No. 5, an ohmic heating means was used to raise the temperature by a temperature elevation rate of 200° C./sec up to 950° C., then the sheet was quenched without holding. The box annealing caused the aluminum plating layer to become alloyed, so even after ohmic heating, the thickness of the Al—Fe alloy layer was constant. The post painting anticorrosion property and spot weldability were evaluated by similar methods to Example 1, whereupon the post painting anticorrosion property was evaluated as being "very good" and the spot weldability as being "good", that is, excellent properties were shown. The Vicker's hardness was also shown to be 482.

Example 4

The steel of Table 1 of Example 1 was used for aluminum plating under the aluminum plating conditions B of Example 1. At this time, the plating coating deposition amount was adjusted to a total of the two sides of 80 to 160 g/m$^2$. Furthermore, after the aluminum plating, a mixture of a finely dispersed ZnO aqueous solution (Nanotech Slurry made by C. I. Kasei) and a urethane-based water-soluble resin was coated by a roll coater and dried at 80° C. At this time, the amounts of deposition of the ZnO film were, converted to Zn, 0.5 to 3 g/m$^2$. These test pieces were hot stamping and quenched.

As the hot stamping conditions at this time, in addition to the furnace heating which is shown in Example 1, an infrared heating furnace was also used. The holding time in the case of furnace heating was 60 sec, while in the case of infrared heating was also 60 sec. Note that, the temperature elevation rate in the infrared heating was approximately 19° C./sec. The thus prepared test piece was evaluated by the same method as in Example 1. The results of evaluation at this time are shown in Table 5. The Vicker's hardness was 420 or more in all cases.

TABLE 5

| No. | Plating deposition amount ($g/m^2$) | Zn deposition amount ($g/m^2$) | Heating method | Heating temp. (° C.) | Plating thickness average (μm) | Plating thickness standard deviation | Standard deviation/ average | Mean linear intercept length (μm) | Post painting anticorrosion property | Spot weld-ability | Remarks |
|---|---|---|---|---|---|---|---|---|---|---|---|
| 1 | 80 | 1.0 | Furnace | 900 | 15 | 1.1 | 0.07 | 9 | Very Good | Good | Inv. ex. |
| 2 | 80 | 1.0 | Infrared | 950 | 14 | 1.2 | 0.09 | 11 | Very Good | Good | Inv. ex. |
| 3 | 80 | 2.0 | Infrared | 950 | 14 | 1.1 | 0.08 | 11 | Very Good | Good | Inv. ex. |
| 4 | 80 | 3.0 | Infrared | 950 | 15 | 1.3 | 0.09 | 10 | Very Good | Good | Inv. ex. |
| 5 | 120 | 0.5 | Infrared | 900 | 23 | 2.0 | 0.09 | 11 | Very Good | Good | Inv. ex. |
| 6 | 160 | 0.5 | Infrared | 900 | 29 | 2.4 | 0.08 | 12 | Very Good | Good | Inv. ex. |
| 7 | 160 | 1.0 | Infrared | 900 | 29 | 2.3 | 0.08 | 12 | Very Good | Good | Inv. ex. |

Test pieces given a ZnO film exhibited excellent post painting anticorrosion property even with a small deposition amount. Further, the spot weldability was also excellent.

The invention claimed is:

1. A method of production of a hot stamped high strength part formed of a steel sheet which is excellent in post painting anticorrosion property, comprising an alloy plating layer comprising an Al—Fe intermetallic compound phase one the surface of the steel sheet, said alloy plating layer is comprised from phases of a plurality of intermetallic compounds, a mean linear intercept length of crystal grains of a phase containing Al: 40 to 65 mass % among said phases of the plurality of intermetallic compounds is 3 to 20 μm, an average value of thickness of said Al—Fe alloy plating layer is 10 to 50 μm, and a ratio of the average value of thickness to the standard deviation of thickness of said Al—Fe alloy plating layer satisfies the following relationship: 0<standard deviation of thickness/average value of thickness ≤0.15, comprising steps of: providing an aluminum plated steel sheet obtained characterized by hot rolling a steel which comprises chemical ingredients which comprise, by mass %, C: 0.1 to 0.5%, Si: 0.01 to 0.7%, Mn: 0.2 to 2.5%, Al: 0.01 to 0.5%, P: 0.001 to 0.1%, S: 0.001 to 0.1%, N: 0.0010% to 0.05%, and a balance of Fe and unavoidable impurities, cold rolling said hot rolled steel to obtain a cold rolled steel sheet, heating said cold rolled steel sheet on a hot dipping line to an annealing temperature of 670 to 760° C., holding said heated steel sheet in a reducing furnace for 60 sec or less, and aluminum plating said steel sheet; and temper rolling said aluminum plated steel sheet to give a rolling rate of 0.5 to 2%; raising the temperature of said temper rolled aluminum plated steel sheet by a temperature elevation rate of 3 to 200° C./sec; hot stamping the aluminum plated steel sheet under conditions of a Larson-Miller parameter (LMP) expressed by the following formula: LMP=T(20+log t) (wherein, T: heating temperature of aluminum plated steel sheet (absolute temperature K), t: holding time in heating furnace after reaching target temperature (hrs)) of 20000 to 23000; and quenching said aluminum plated steel sheet after hot stamping at a 20 to 500° C./sec cooling rate in the die.

2. The method of production of a hot stamped high strength part as set forth in claim 1 characterized in that said steel furthermore comprises, by mass %, one or more of the elements selected from Cr: over 0.4 to 3%,
Mo: 0.005 to 0.5%,
B: 0.0001 to 0.01%,
W: 0.01 to 3%,
V: 0.01 to 2%,
Ti: 0.005 to 0.5%,
Nb: 0.01 to 1%,
Ni: 0.01 to 5%,
Cu: 0.1 to 3%,
Sn: 0.005% to 0.1%, and
Sb: 0.005% to 0.1%.

3. The method of production of a hot stamped high strength part as set forth in claim 1 or 2 characterized in that in the temperature elevation rate in said hot stamping step is 4 to 200° C./sec.

4. The method of production of a hot stamped high strength part as set forth in claim 1 or 2 characterized in that in the step of producing said aluminum plated steel sheet, a plating bath for aluminum plating comprises Si in an amount of 7 to 15%, and either a bath temperature or a sheet temperature upon entering the bath is 650° C. or less.

5. The method of production of a hot stamped high strength part as set forth in claim 3 characterized in that in the step of producing said aluminum plated steel sheet, a plating bath for aluminum plating comprises Si in an amount of 7 to 15%, and either a bath temperature or a sheet temperature upon entering the bath is 650° C. or less.

* * * * *